US006641713B2

(12) United States Patent
Nishi et al.

(10) Patent No.: US 6,641,713 B2
(45) Date of Patent: Nov. 4, 2003

(54) APPARATUS AND SYSTEM FOR REFINING SODIUM

(75) Inventors: Toshiro Nishi, Nagasaki (JP); Chisato Tsukahara, Nagasaki (JP); Hitoshi Kaguchi, Kobe (JP); Yukinori Usui, Kobe (JP); Kazuya Kurome, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/886,253

(22) Filed: Jun. 22, 2001

(65) Prior Publication Data

US 2002/0079214 A1 Jun. 27, 2002

(30) Foreign Application Priority Data

Jun. 27, 2000 (JP) ..... 2000-192514
May 24, 2001 (JP) ..... 2001-154887

(51) Int. Cl.[7] ..... C25C 3/02; C25C 1/02; C25C 3/00; C25B 9/00

(52) U.S. Cl. ..... 205/408; 205/633; 204/245; 204/251

(58) Field of Search ..... 204/243.1, 244, 204/245, 251; 205/633, 408

(56) References Cited

U.S. PATENT DOCUMENTS 3,947,334 A * 3/1976 Yamanouchi ..... 204/243.1

FOREIGN PATENT DOCUMENTS

| | | | |
|---|---|---|---|
| DE | 41 10 324 | * | 1/1992 |
| EP | 0 482 388 | | 4/1992 |
| JP | 60-002686 | * | 8/1985 |
| JP | 06-172883 | * | 6/1994 |

OTHER PUBLICATIONS

Patent Abstracts of Japan, JP 06–172883, Jun. 21, 1994.
Patent Abstract of Japan, JP 60–002687, Jan. 8, 1985.

* cited by examiner

*Primary Examiner*—Patrick Ryan
*Assistant Examiner*—Thomas H. Parsons
(74) *Attorney, Agent, or Firm*—Oblon, Spivak, McClelland, Maier & Neustadt, P.C.

(57) ABSTRACT

An object of the invention is to provide a sodium refining apparatus which has a simple constitution and does not deteriorate a solid electrolyte employed therein. The sodium refining apparatus of the invention, in which impurities contained in sodium are removed by a solid electrolyte having sodium ion conductivity, includes a bottom-closed casing made of a solid electrolyte and containing a small amount of highly pure sodium; an outer casing accommodating said bottom-closed casing and containing, outside said bottom-closed casing, impurity-containing sodium; a first electrode inserted in the impurity-containing sodium; a second electrode inserted in the highly pure sodium; and a power source for applying DC voltage to the electrodes; wherein the impurity-containing sodium and the highly pure sodium are in electrical contact with each other via the solid electrolyte.

10 Claims, 11 Drawing Sheets

Impurity elements
Refinement ratio (D) (before/after) (200°C)

Impurity elements
Refinement ratio (D) (before/after) (350°C)

APPARATUS AND SYSTEM FOR REFINING SODIUM

BACKGROUND OF THE INVENTION

The entire disclosure of Japanese Patent Applications No. 2000-192514 filed on Jun. 27, 2000 and No. 2001-154887 filed on May 24, 2001 including specification, claims, drawings and summary is incorporated herein by reference in its entirety.

1. Field of the Invention

The present invention relates to an apparatus for refining sodium (hereinafter referred to as a sodium refining apparatus), the sodium containing impurities such as oxides and hydroxides, and to a system for refining sodium ago (hereinafter referred to as a sodium refining system).

2. Description of the Related Art

Sodium is employed as a coolant or like material in facilities such as nuclear power plants, and impurities such as oxides and hydroxides possibly migrate into sodium during its use.

Conventionally, some impurities are removed through a technique such as cold trapping, in which sodium is cooled and impurities are trapped by use of metallic material such as zirconium (Zr).

Although suitable for removing impurities such as oxygen and hydrogen, cold trapping is not suitable for removing impurities such as oxides and hydroxides.

Thus, there has previously been proposed a sodium refining apparatus attaining high purity on the basis of a technique of an alkali metal thermo-electric converter (AMTEC) (Japanese Patent Application Laid Open (kokai) No. 6-172883).

FIG. 11 (PRIOR ART) shows a schematic representation of the apparatus disclosed in the above publication.

In FIG. 11 (PRIOR ART), β"-alumina (hereinafter referred to simply as "β-alumina") is employed as a solid electrolyte. A heating chamber 03 and a condensation chamber 04 are provided, along with a βalumina-made separator 01 disposed therebetween. In the condensation chamber 04, a porous electrode 02 is formed on the separator 01. A lead connecting the porous electrode 02 with impurity-containing sodium 06 contained in the heating chamber 03 is electrically connected to a resistor 010, a heater 07 provided in the heating chamber 03, or cooling means 013 for cooling a cooling section 012 of the condensation chamber 04.

In such an apparatus, sodium is heated to 900–1,300 K, to thereby form sodium cations. The difference in vapor pressure between the heating chamber and the condensation chamber urges the thus-formed sodium cations to transfer through the solid electrolyte, and the cations reach the surface (facing the cooling section of the condensation chamber) of the solid electrolyte. The released electrons are supplied, via a lead connecting the porous electrode with sodium contained in the heating chamber, to the interface between the porous electrode and the solid electrolyte, where the electrons are recombined with the sodium ions which have been supplied through the solid electrolyte. The thus-formed electrically neutral sodium vaporizes at the surface of the electrolyte and is condensed in the cooling section, to thereby yield pure sodium.

However, during operation of the aforementioned prior art refining apparatus, sodium contained in the heating chamber 03 must be heated to at least 900 K (623° C.), and therefore, deterioration of β-alumina is accelerated, resulting in poor durability.

In addition, the differences in temperature and vapor pressure of the sodium chamber must be maintained constant throughout the refining process, and the porous electrode must be attached directly to the surface of the electrolyte. Thus, configuration and operation of such an apparatus require increased costs.

Although β-alumina is suitable for refining sodium; i.e., removing impurities such as oxides and hydroxides, efficient removal of oxygen cannot be attained. Thus, when the sodium refined by use of β-alumina is used for a long period of time, corrosion of piping in the apparatus may occur. In order to prevent this problematic corrosion, cold trap means must be added, but such additional means inevitably increases the size of the refining apparatus.

SUMMARY OF THE INVENTION

In view of the foregoing, the present inventors have carried out extensive studies to solve the problems. Accordingly, an object of the present invention is to provide a sodium refining apparatus of simple structure which is free from the problem of deterioration of solid electrolyte. Another object of the invention is to provide a sodium refining system including the refining apparatus.

In one aspect of the present invention, there is provided an apparatus for refining sodium, in which impurities contained in sodium are removed by a solid electrolyte having sodium ion conductivity, the apparatus comprising:

a bottom-closed casing made of a solid electrolyte and for containing impurity-containing sodium or a small amount of highly pure sodium;

an outer casing for accommodating said bottom-closed casing and for containing, outside said bottom-closed casing, a small amount of highly pure sodium when said bottom-closed casing contains impurity-containing sodium, and impurity-containing sodium when said bottom-closed casing contains highly pure sodium;

a first electrode to be inserted in the impurity-containing sodium or in the highly pure sodium;

a second electrode to be inserted in the highly pure sodium when the first electrode is inserted in the impurity-containing sodium, or in the impurity-containing sodium when the first electrode is inserted in the highly pure sodium; and a power source for applying DC voltage to the electrodes; wherein the impurity-containing sodium and the highly pure sodium are in electrical contact with each other via the solid electrolyte;

and when the DC voltage is applied, the impurity-containing sodium is positively charged and the highly pure sodium is negatively charged, to thereby ionize sodium contained in the impurity-containing sodium; and the thus-formed sodium cations are caused to pass through the solid electrolyte and, subsequently, are combined with electrons at the surface of the solid electrolyte, to thereby yield refined sodium.

Preferably, the liquid-surface level of the bottom-closed casing formed of solid electrolyte and that of the outer casing are adjusted to be approximately equal to each other.

Preferably, the solid electrolyte is formed of β-alumina.

Preferably, the electrodes are formed of a material which is highly anti-corrosive against sodium, such as molybdenum (Mo), tungsten (W), or stainless steel.

Preferably, in the apparatus, sodium is refined at 200–500° C.

In another aspect of the present invention, there is provided a system for refining sodium, the system comprising the aforementioned apparatus for refining sodium; supply means for supplying impurity-containing sodium into the outer casing of the apparatus for refining sodium; and sodium-recovery means for recovering sodium refined by means of the apparatus for refining sodium.

Preferably, the system further includes oxygen-removal means for removing oxygen contained in refined sodium.

Preferably, in the system, refined sodium is supplied from the sodium-recovery means to a reactor; the supplied sodium is used in the reactor; and, subsequently, the resultant impurity-containing sodium is supplied again to the supply means for supplying impurity-containing sodium.

Preferably, in the system, the impurity-containing sodium is a coolant used in a fast-breed reactor.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with accompanying drawings, in which.

DETAILED DESCRIPTION OF PREFERRED EMBODIMENTS

The present invention will next be described in detail with reference to the Embodiments, which should not be construed as limiting the invention thereto.

Embodiment 1

Figure 1:
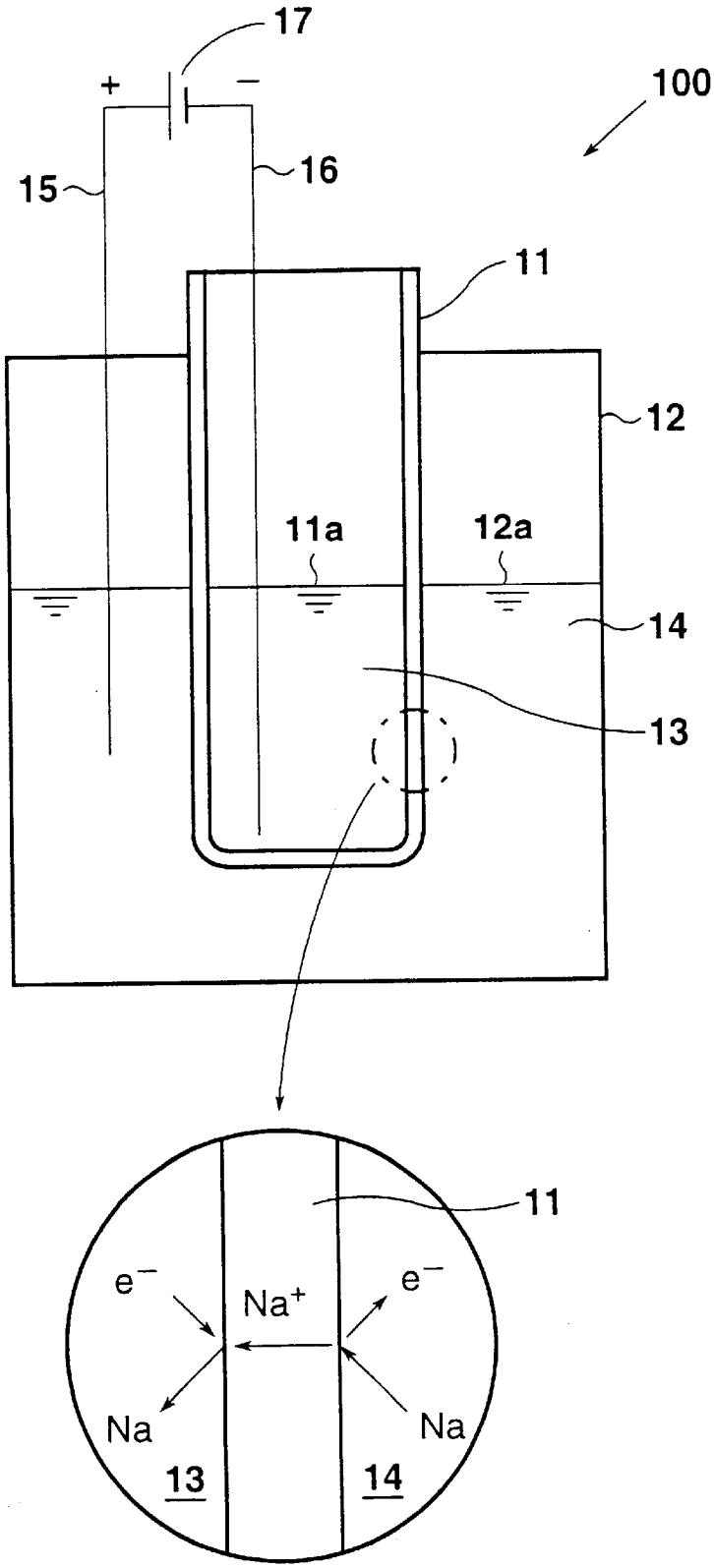
FIG. 1 is a schematic representation of a sodium refining apparatus according to a first embodiment of the present invention.

FIG. 1 shows a schematic representation of a sodium refining apparatus according to Embodiment 1 of the present invention.

As shown in FIG. 1, the sodium refining apparatus 100 according to the present embodiment is an apparatus for refining sodium, in which an impurity contained in sodium is removed by means of a solid electrolyte having sodium ion conductivity. The apparatus comprises a bottom-closed casing 11 made of a solid electrolyte and containing a small amount of refined sodium (hereinafter referred to as highly pure sodium) 13; an outer casing 12 accommodating said bottom-closed casing 11 and containing, outside said bottom-closed casing 11, impurity-containing sodium 14; a first electrode 15 inserted in the impurity-containing sodium 14; a second electrode 16 inserted in the highly pure sodium 13; and a power source 17 for applying DC voltage to the electrodes 15, 16; wherein the impurity-containing sodium 14 and the highly pure sodium 13 are in electrical contact with each other via the solid electrolyte.

In the present embodiment, the impurity-containing sodium 14 is charged in the outer casing 12, and the highly pure sodium 13 is charged in the bottom closed casing made of a solid electrolyte. However, the present invention is not limited to this configuration, and the converse configuration is also acceptable.

As shown in the partial enlargement in FIG. 1, DC voltage is applied to the electrodes such that the impurity-containing sodium 14 placed in the outer casing 12 is positively charged, and the highly pure sodium 13 is negatively charged, to thereby ionize sodium (Na) contained in the impurity-containing sodium 14. The thus-formed sodium ions ($Na^+$) are urged to pass through the casing 11 made of a solid electrolyte and, subsequently, recombined with electrons ($e^-$) at the surface of the electrolyte, to thereby yield refined (highly pure) sodium 13.

In this embodiment, the liquid-surface level 11*a* of the aforementioned bottom-closed casing 11 made of solid electrolyte and the liquid-surface level 12*a* of the outer casing 12 are adjusted to be equal, to thereby effectively refine impurity-containing sodium.

The reason for making the levels of the two liquid surfaces equal is that any difference in liquid level generates a portion which conducts no electricity, thereby inhibiting the transfer of sodium ions.

In the present invention, β-alumina is particularly preferred as the above electrolyte. As used herein, β-alumina refers to compounds represented by $Na_2O—Al_2O_3$, with a composition of $Na_2O{\cdot}5.33Al_2O_3$ being ideal.

The solid electrolyte allows selective passage of sodium, to thereby remove impurities such as oxides and hydroxides contained in sodium.

The target impurities to be removed in the present invention include fission products as well as the aforementioned species. In other words, sodium contaminated with nuclear species can also be the target for refining.

The electrode which is to be inserted in the aforementioned sodium is preferably formed of a material which is highly resistant to sodium; e.g., molybdenum (Mo), tungsten (W), or stainless steel. The reason for employment of such a material is that a material which is insufficiently resistant to sodium such as platinum (Pt) dissolves in and migrates into sodium, thereby preventing effective refinement of sodium.

Figure 2:
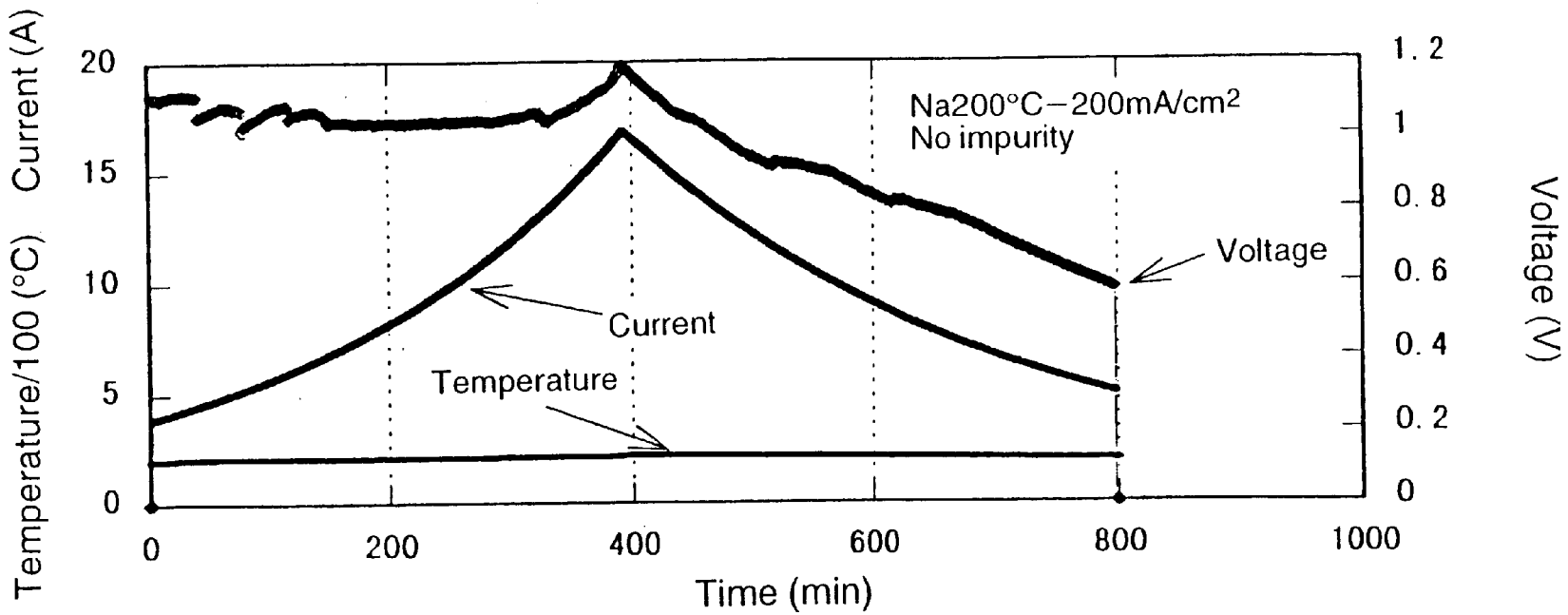
FIG. 2 is a chart showing the change in voltage during sodium refining at 200° C.
Figure 3:
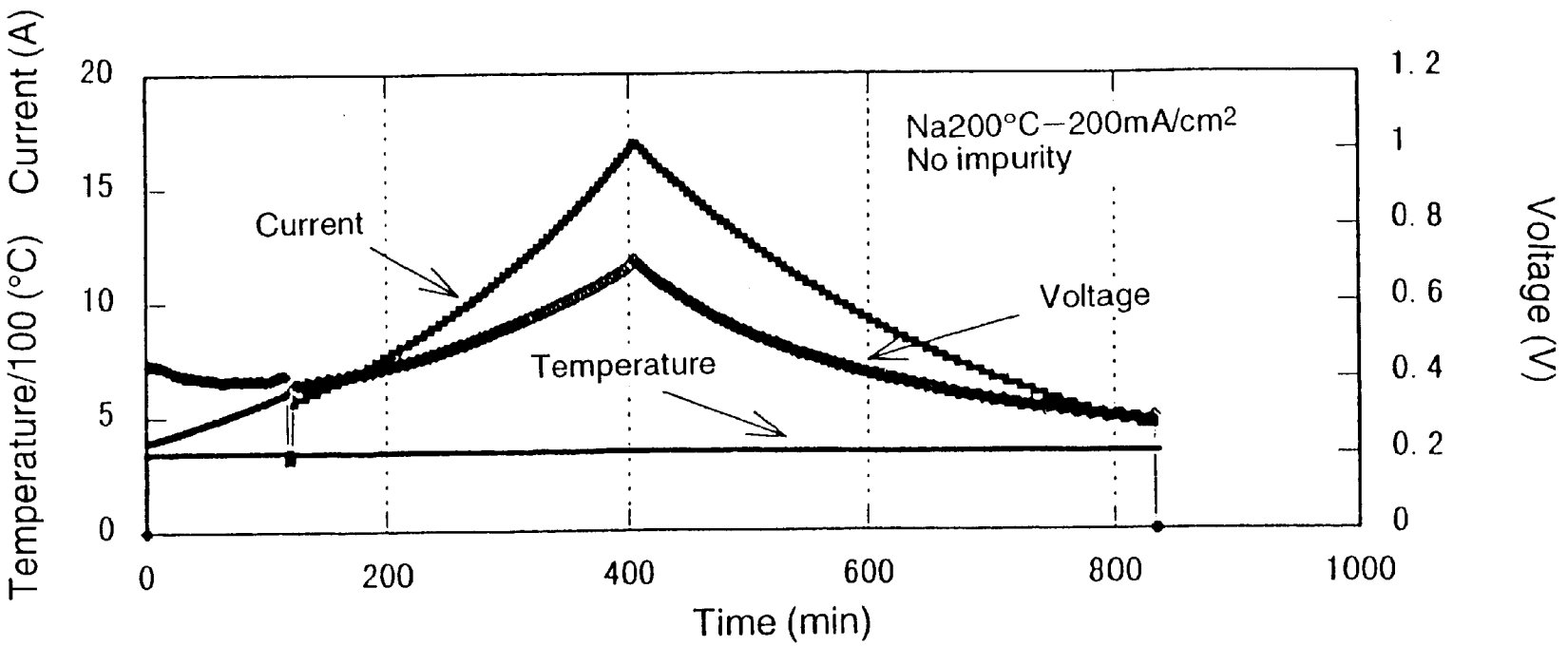
FIG. 3 is a chart showing the change in voltage during sodium refining at 350° C.

The aforementioned sodium refining can be performed at a relatively low temperature; i.e., 200–500° C., preferably 300–400° C. (see FIGS. 2 and 3).

Temperatures lower than 200° C. are not preferred, in view of electrical resistance generated through electrode reaction. This unwanted effect can be eliminated when the temperature is elevated over 200° C. However, temperature elevation requires a heat source which can provide a temperature higher than 200° C. Thus, the refining temperature is appropriately determined within the range of 200–500° C., in consideration of refining cost.

The refining apparatus of the present invention includes the bottom-closed casing 11 formed of solid electrolyte inside the outer casing 12. Thus, the apparatus can be made compact and provides excellent sealing characteristics and enhanced mechanical strength.

Figure 4:
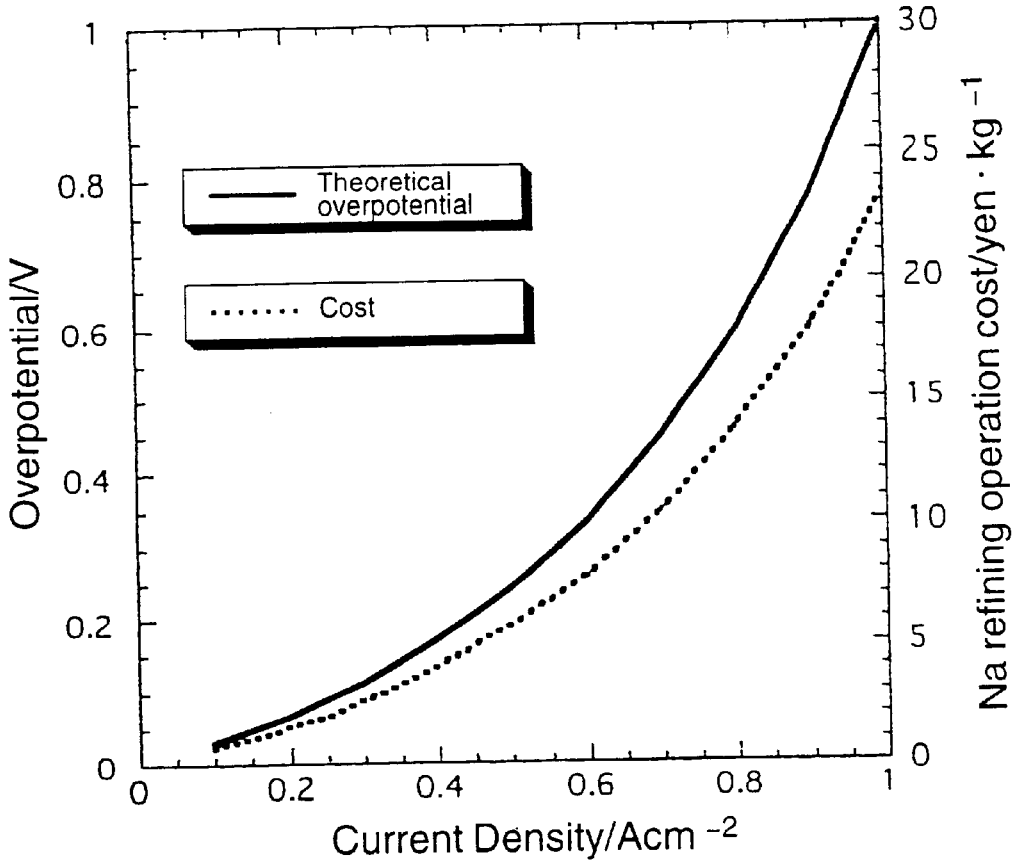
FIG. 4 is a graph showing a simulated calculation of operation cost incurred by the sodium refining apparatus.

FIG. 4 is a graph showing an exemplary simulated calculation of operational cost of the sodium refining apparatus. As shown in FIG. 4, the apparatus of the present invention can refine sodium at a considerably low operational cost.

Thus, the present invention has successfully achieved continuous removal of impurities while refining sodium at low cost.

Figure 5A:
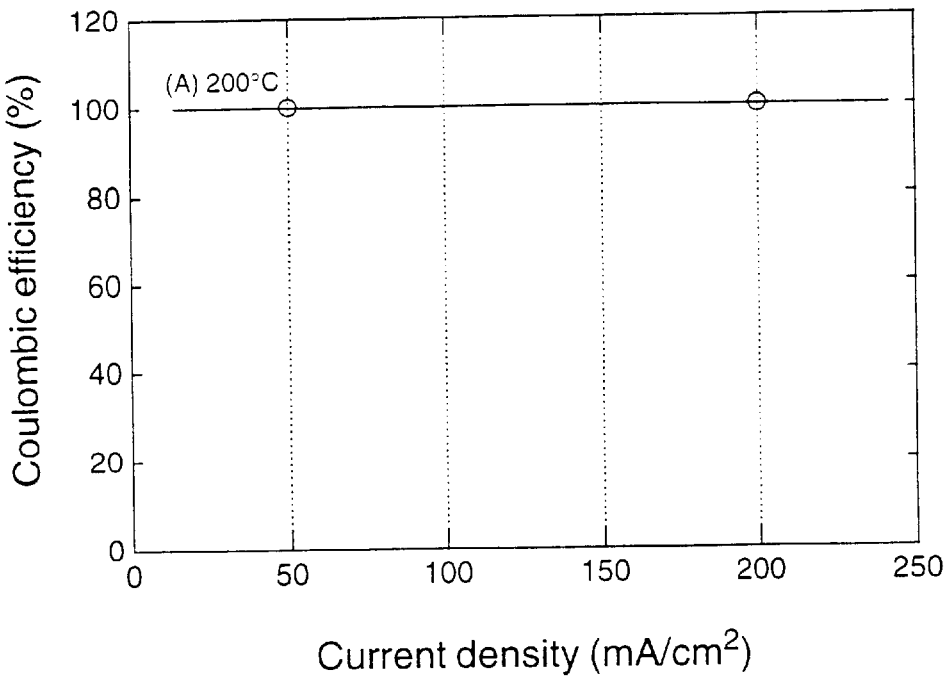
FIGS. 5A and 5B show coulombic efficiency during sodium refining.
Figure 5B:
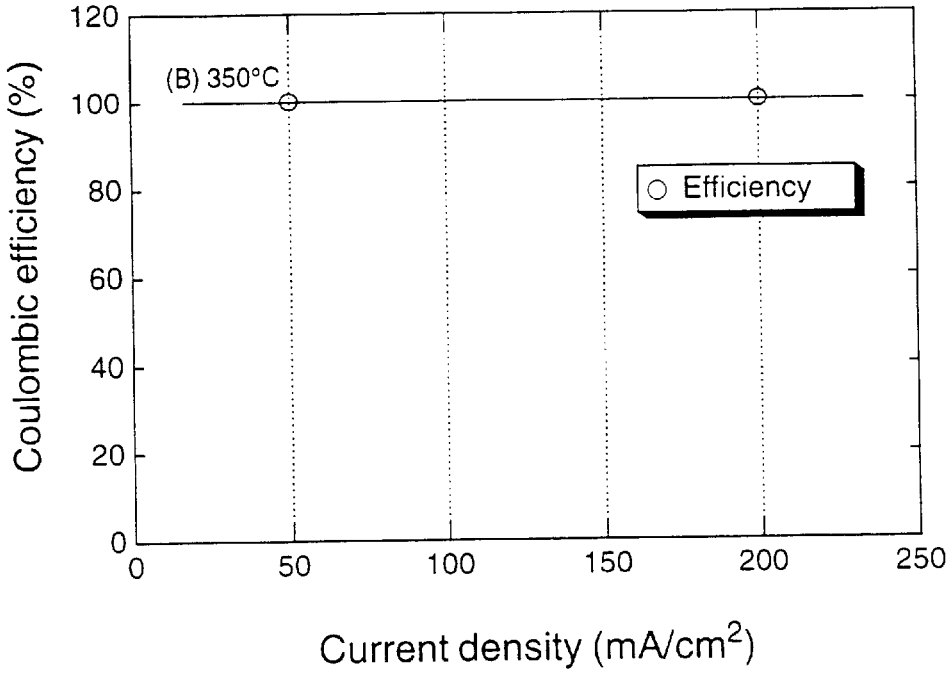

As shown in FIGS. 5A and 5B, the coulombic efficiency during sodium refining reaches 100%. Accordingly, all the supplied current is consumed to refine sodium, to thereby enable very easy control of sodium refining.

Figure 6A:
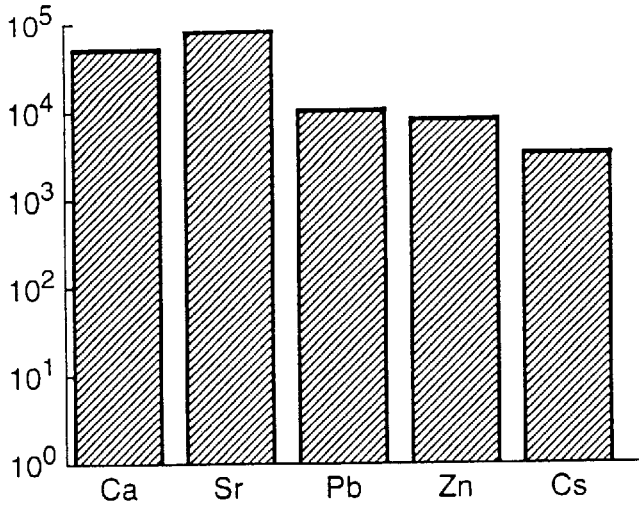
FIG. 6A shows refinement ratios of impurity elements present before refining to that after refining at 200° C.
Figure 6B:
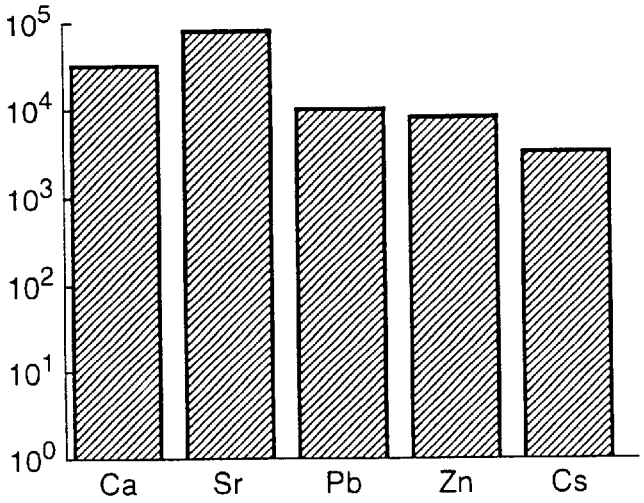
FIG. 6B shows refinement ratios of impurity elements present before refining to that after refining at 350° C.

FIGS. 6A and 6B show refinement ratios (D) [(D)=(impurity elements present before refining)/(impurity elements present after refining)] at 200° C. and 350° C., respectively. As shown in FIGS. 6A and 6B, the thus refined sodium shows $D=10^3$ or higher ($D=10^4$ or higher in terms of Ca and Sr) at both 200° C. and 350° C. Thus, high sodium refinement efficiency has been confirmed.

The analysis was performed through ICP (inductively coupled plasma atomic emission spectrochemical analysis), which features a small quantitation limit.

Figure 7:
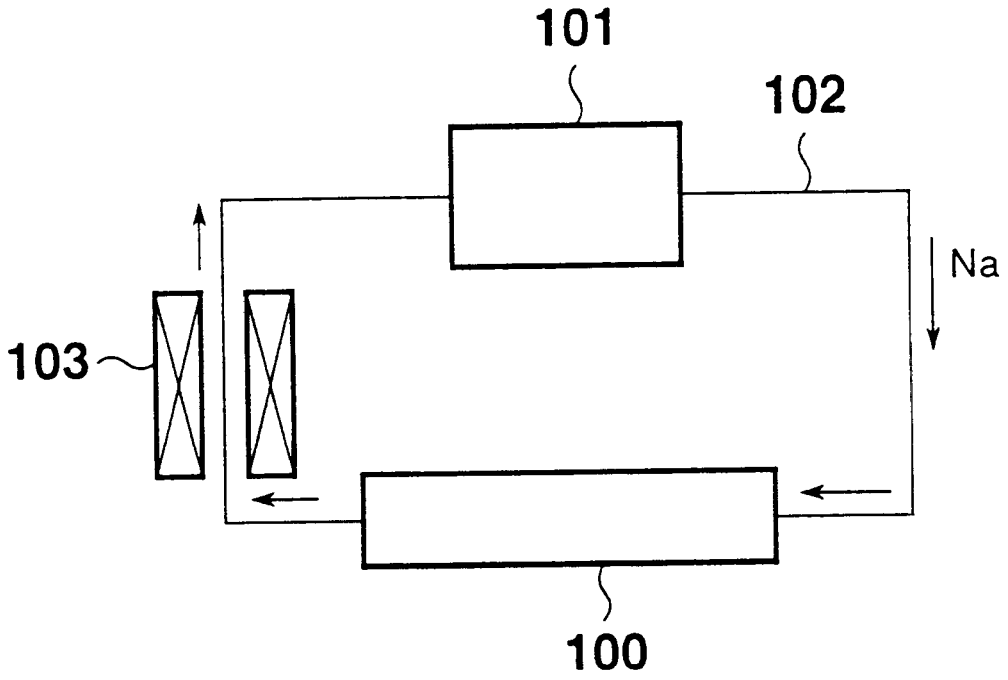
FIG. 7 shows a system for continuously refining sodium.

The sodium refining apparatus of the present invention maybe employed in a single batch process or a continuous refining process. In the latter case, as shown in FIG. 7, a sodium refining apparatus 100 is inserted in a sodium passage 102 within a reactor 101, and sodium is circulated by means of a electromagnetic pump 103, to thereby carry out a continuous refining process.

Embodiment 2

Continuous sodium refining will next be described by reference to Embodiment 2.

Figure 8:
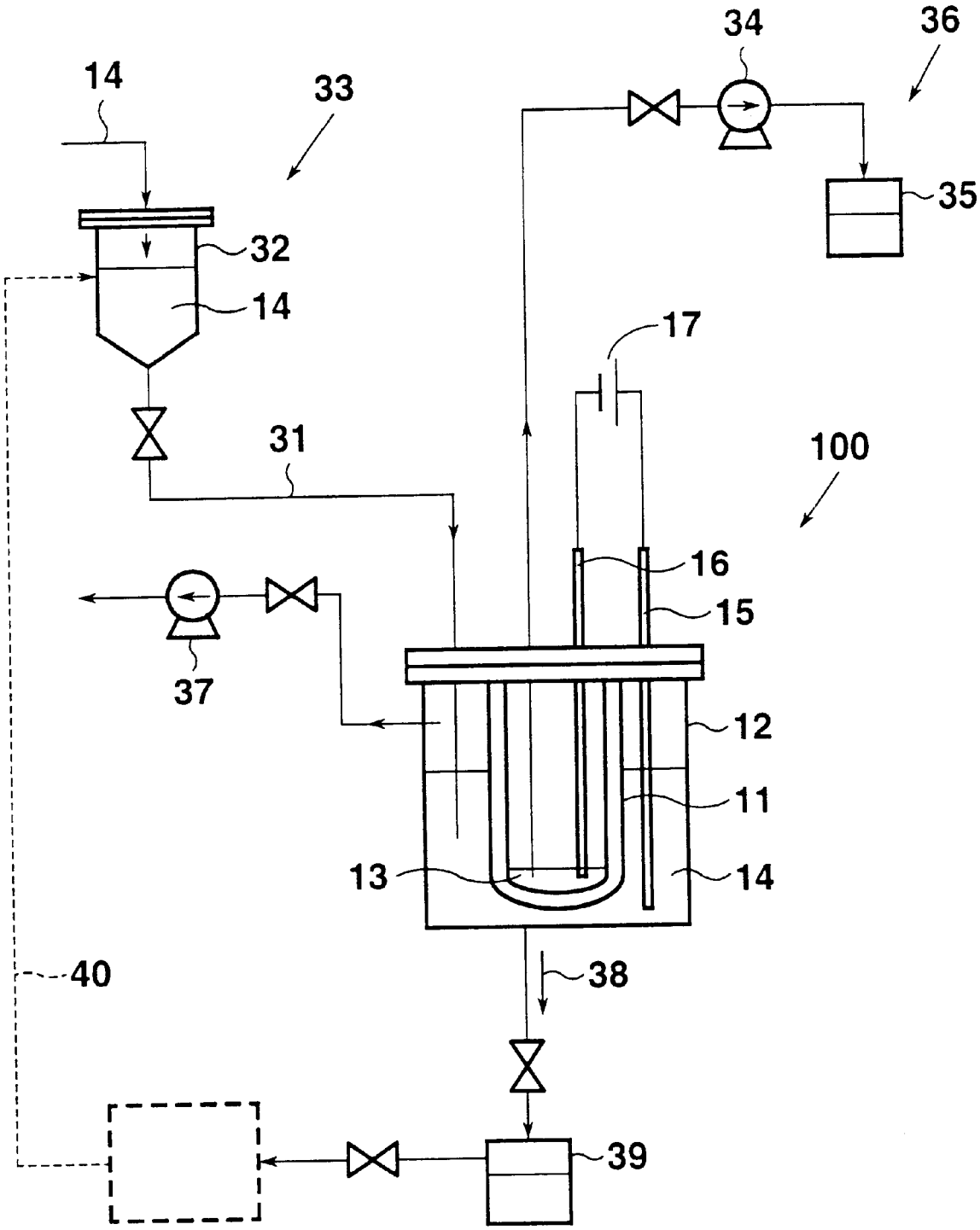
FIG. 8 shows a system for continuously refining sodium.

FIG. 8 schematically shows a system for continuously refining sodium according to Embodiment 2.

As shown in FIG. 8, the system comprises the aforementioned sodium refining apparatus 100 as shown in FIG. 1; impurity-containing-sodium-supply means 33 which supplies, via a supply pipe 31, impurity-containing sodium 14 from a supply tank 32 to an outer casing 12 of the sodium refining apparatus 100; and sodium-recovery means 36 which recovers sodium 13 refined by the sodium refining apparatus 100 into a recovery tank 35 by means of a pump 34.

In Embodiment 2, a vacuum pump 37 is provided so as to automatically supply impurity-containing sodium 14 into the outer casing 12.

A residue 38 generated during sodium refining and remaining in the outer casing 12 contains highly condensed impurities. A predetermined amount of the residue 38 is transferred into a buffer tank 39, and is subsequently subjected to waste treatment. The waste treatment can be carried out through any known method.

Thus, sodium containing large amounts of impurities can also be treated at low cost by use of the refining apparatus of the present invention.

In addition, if a line 40 (represented by a dashed line in FIG. 8) for feeding sodium from the aforementioned buffer tank 39 back to the supply tank 32 is provided, sodium can be recycled, to thereby reduce the volume thereof.

Embodiment 3

Continuous sodium refining will next be described by reference to Embodiment 3.

Figure 9:
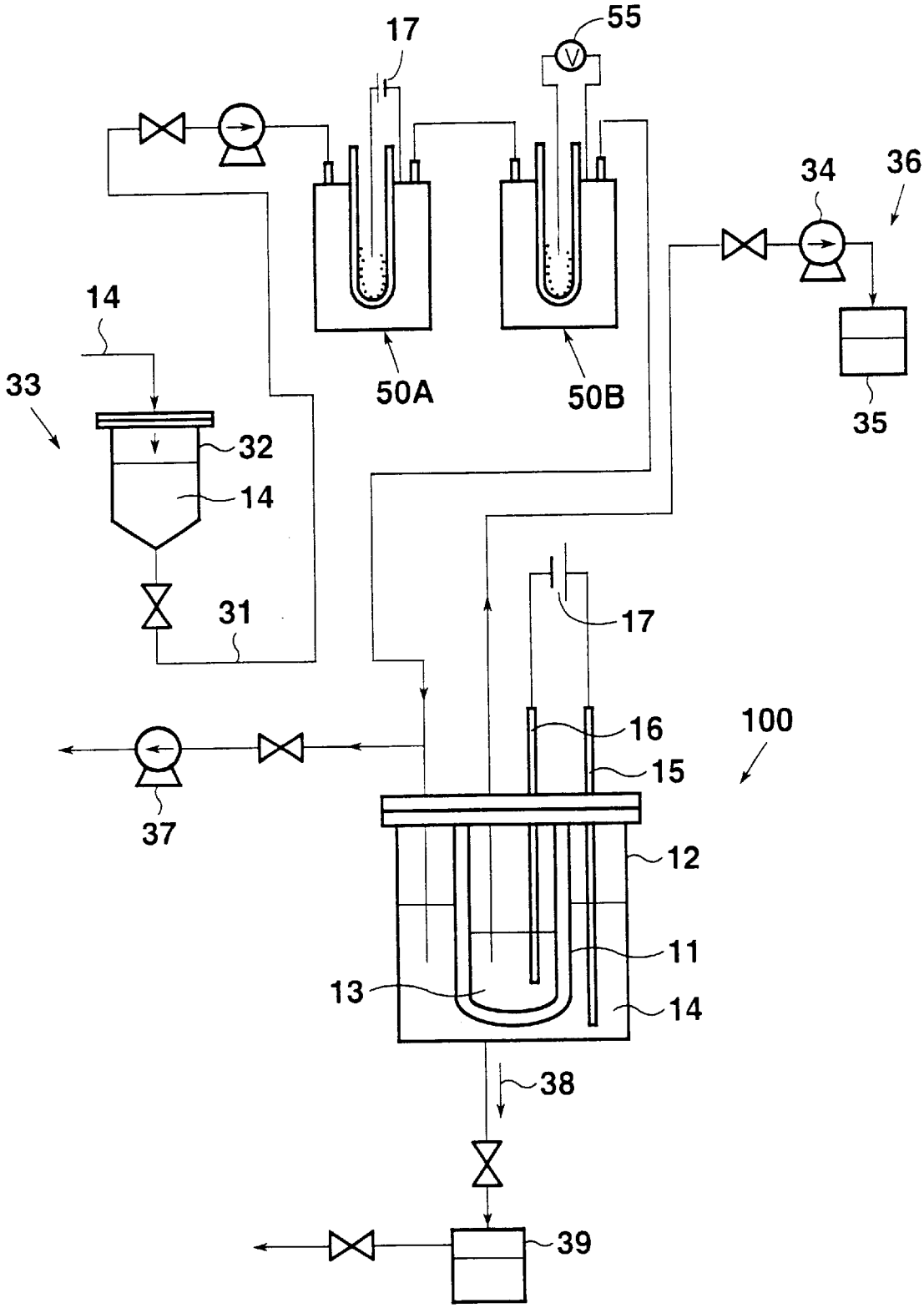
FIG. 9 shows a system for continuously refining sodium.

FIG. 9 schematically shows a system for continuously refining sodium according to Embodiment 3.

As shown in FIG. 9, the system comprises the aforementioned sodium refining apparatus 100 as shown in FIG. 1; impurity-containing sodium supply means 33 which supplies, via a supply pipe 31, impurity-containing sodium 14 from a supply tank 32 to an outer casing 12 of the sodium refining apparatus 100; sodium-recovery means 36 which recovers sodium 13 refined by the sodium refining apparatus 100 into a recovery tank 35 by means of a pump 34; and an oxygen-removing apparatus 50 for removing oxygen contained in impurity-containing sodium 14, the apparatus 50 being inserted in the supply pipe 31.

Removal of dissolved oxygen by means of the aforementioned oxygen-removing apparatus 50 is for mitigating corrosion of β-alumina and piping.

Figure 10:
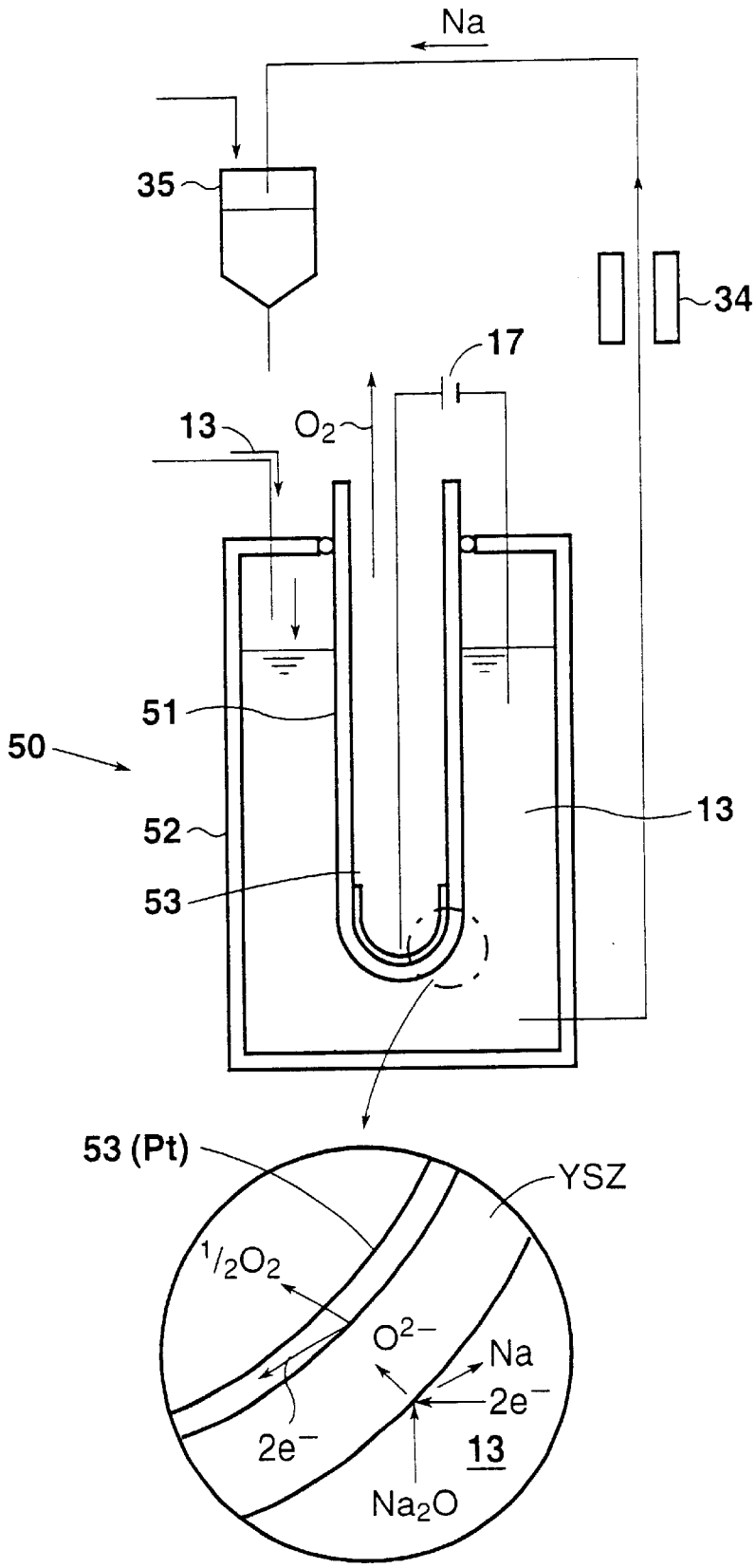
FIG. 10 shows an oxygen-removing apparatus.
Figure 11:
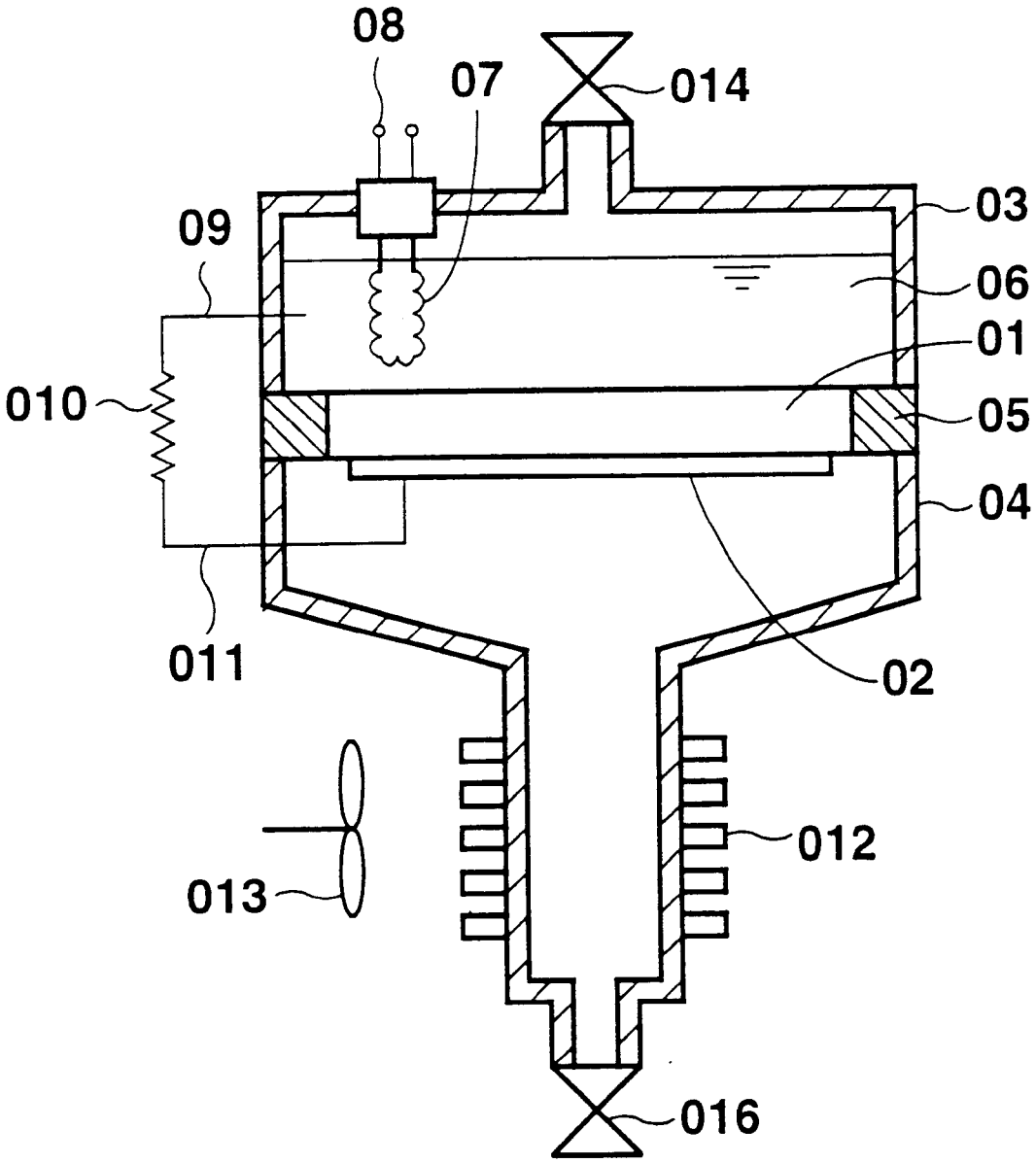
FIG. 11 PRIOR ART
FIG. 11 shows a conventional sodium refining apparatus.

As shown in FIG. 10, the oxygen-removing apparatus 50 comprises a bottom-closed, hollow cylindrical tube 51 made of an oxygen-ion-conductor, the tube being provided inside an outer casing 52.

The bottom of the cylindrical tube 51 is lined with a platinum electrode 53, whereby DC voltage is applied at approximately 350° C, to thereby selectively cause oxygen to migrate.

The aforementioned oxygen-ion-conductor may be formed of YSZ (yttria-stabilized zirconia). As shown in the enlarged view included in FIG. 10, electricity is supplied such that the sodium serves as a cathode and the platinum electrode 53 serves as an anode. As a result, oxygen contained in sodium is ionized, and oxygen gas is discharged through YSZ.

Specifically, reaction represented by scheme (1) occurs at the platinum electrode 53, and reaction represented by scheme (2) occurs at the interface between sodium and YSZ. Thus, overall reaction is represented by scheme (3) (note that $Na_2O$ contained in sodium is decomposed into Na and $O_2$).

$$\text{Pt electrode: } O^{2-} \rightarrow \tfrac{1}{2}O_2 + 2e^- \quad (1)$$

$$\text{Na: } 2e^- + Na_2O \rightarrow 2Na + O^{2-} \quad (2)$$

$$\text{Overall: } Na_2O \rightarrow 2Na + \tfrac{1}{2}O_2 \quad (3)$$

Thus, oxygen contained in refined sodium 13 can be removed, to thereby prevent corrosion-induced damage to piping during re use of the refined sodium.

In FIG. 9, two units of the aforementioned oxygen-removing apparatus 50 are provided. A first apparatus 50A serves as an apparatus for removing oxygen by applying DC voltage supplied from a power source 17, while a second apparatus 50B, equipped with a voltmeter 55 instead of the power source 17, measures the oxygen concentration. The measurement of the oxygen concentration is based on the theory of an oxygen concentration cell. Specifically, based on air (21% oxygen) as a reference, electromotive force induced by the oxygen concentration ($P(O_2)$) of sodium can be obtained by the following equation:

$$E=(RT/nF)ln(0.12/2P(O_2))$$

wherein R, T, n, and F represent the gas constant, absolute temperature, the number of electrons involved in the reaction (n=4), and the Faraday constant, respectively.

The oxygen concentration of Na can be calculated from the voltage in accordance with the above equation.

Thus, sodium containing large amounts of impurities can also be treated at low cost by use of the refining apparatus and system of the present invention.

In addition, sodium may be recycled from the aforementioned buffer tank 39 to the supply tank 32, to thereby reduce the volume thereof.

By use of the sodium refining apparatus of the present invention, which has a simple structure, sodium can be effectively refined. When β-alumina is employed as a solid electrolyte, coulombic efficiency reaches 100%, facilitating sodium ion transfer. Use of an electrode material which is highly anti-corrosive against sodium prevents dissolution of ingredients of the electrode material in sodium. The apparatus can be operated at 500° C. or lower, to thereby prevent deterioration of a solid electrolyte.

By use of the sodium refining system of the present invention, sodium can be refined in a continuous manner. When oxygen-removal means is provided in the system, corrosion of piping in the system can be prevented. In addition, refined sodium may be recycled.

What is claimed is:

1. A method for refining sodium, in which impurities contained in sodium are removed by a solid electrolyte having sodium ion conductivity, the method comprising the steps of:

applying a DC voltage to an impurity-containing sodium;

measuring oxygen concentration of the impurity-containing sodium;

containing the impurity-containing sodium or a lesser amount of highly pure sodium in a bottom-closed casing made of a solid electrolyte;

accommodating said bottom-closed casing in an outer casing and containing, outside said bottom-closed casing, a highly pure sodium when said bottom-closed casing contains impurity-containing sodium, or impurity-containing sodium when said bottom-closed casing contains highly pure sodium, wherein the amount of highly pure sodium contained outside said bottom-closed casing when the bottom-closed casing contains impurity-containing sodium is smaller than the amount of impurity-containing sodium contained outside said bottom-closed casing when the bottom-closed casing contains highly pure sodium;

inserting a first electrode in the impurity-containing sodium or in the highly pure sodium;

inserting a second electrode in the highly pure sodium when the first electrode is inserted in the impurity-containing sodium, or in the impurity-containing sodium when the first electrode is inserted in the highly pure sodium;

applying DC voltage to the electrodes; and adjusting the liquid-surface level of the bottom-closed casing formed of solid electrolyte and that of the outer casing to be approximately equal to each other;

wherein the impurity-containing sodium and the highly pure sodium are in electrical contact with each other via the solid electrolyte;

and when the DC voltage is applied, the impurity-containing sodium is positively charged and the highly pure sodium is negatively charged, to thereby ionize sodium contained in the impurity-containing sodium; and the thus-formed sodium cations are caused to pass through the solid electrolyte and, subsequently, are combined with electrons at the surface of the solid electrolyte, to thereby yield refined sodium.

2. The method for refining sodium according to claim 1, wherein the solid electrolyte is formed of β-alumina.

3. The method for refining sodium according to claim 1, wherein the electrodes are formed of a material which is highly anti-corrosive against sodium, and is selected from the group consisting of molybdenum (Mo), tungsten (W), and stainless steel.

4. The method for refining sodium according to claim 1, wherein sodium is refined at 200–500° C.

5. A method for refining sodium according to claim 1, wherein the impurity-containing sodium is a coolant used in a fast-breed reactor.

6. A system for refining sodium, the system comprising an apparatus for refining sodium as recited in claim 1; and further comprising supply means for supplying impurity-containing sodium into the outer casing of the apparatus for refining sodium; and sodium-recovery means for recovering sodium refined by means of the apparatus for refining sodium.

7. A system for refining sodium according to claim 6, wherein refined sodium is supplied from the sodium-recovery means to a reactor; the supplied sodium is used in the reactor; and, subsequently, the resultant impurity-containing sodium is supplied again to the supply means for supplying impurity-containing sodium.

8. A system for refining sodium, the system comprising an apparatus for refining sodium as recited in claim 3; and further comprising supply means for supplying impurity-containing sodium into the outer casing of the apparatus for refining sodium; and sodium-recovery means for recovering sodium refined by means of the apparatus for refining sodium.

9. A system for refining sodium, the system comprising an apparatus for refining sodium as recited in claim 4; and further comprising supply means for supplying impurity-containing sodium into the outer casing of the apparatus for refining sodium; and sodium-recovery means for recovering sodium refined by means of the apparatus for refining sodium.

10. A system for refining sodium in which impurities contained in sodium are removed by a solid electrolyte having sodium ion conductivity, the system comprising:

an oxygen removing apparatus configured to apply a DC voltage to an impurity-containing sodium and measure oxygen concentration of the impurity-containing sodium;

an apparatus for refining sodium, comprising a bottom-closed casing made of a solid electrolyte and configured to contain the impurity-containing sodium or a lesser amount of highly pure sodium, an outer casing configured to accommodate said bottom-closed casing and to contain, outside said bottom-closed casing, a highly pure sodium when said bottom-closed casing contains impurity-containing sodium, or impurity-containing sodium when said bottom closed casing contains highly pure sodium, wherein the amount of highly pure sodium contained outside said bottom-closed casing when the bottom-closed casing contains impurity-containing sodium is smaller than the amount of impurity-containing sodium contained outside said bottom-closed casing when the bottom-closed casing contains highly pure sodium, a first electrode configured to be inserted in the impurity-containing sodium or in the highly pure sodium, a second electrode configured to be inserted in the highly pure sodium when the first electrode is inserted in the impurity-containing sodium, or in the impurity-containing sodium when the first electrode is inserted in the highly pure sodium, and a power source configured to apply DC voltage to the electrodes;

supply means for supplying impurity-containing sodium into the outer casing of the apparatus for refining sodium;

sodium-recovery means for recovering sodium refined by the apparatus for refining sodium; and oxygen-removal means for removing oxygen contained in refined sodium;

wherein refined sodium is supplied from the sodium-recovery means to a reactor; the supplied sodium is used in the reactor, and the supply means is configured to receive the resultant impurity-containing sodium.

* * * * *